United States Patent [19]

Taylor

[11] Patent Number: 4,572,557

[45] Date of Patent: Feb. 25, 1986

[54] LOCKING DEVICE FOR SLIDING DOORS AND/OR WINDOWS

[76] Inventor: Raymond R. Taylor, 6816 E. 95th, Tulsa, Okla. 74133

[21] Appl. No.: 589,131

[22] Filed: Mar. 13, 1984

[51] Int. Cl.[4] ..... E05C 17/34

[52] U.S. Cl. ..... 292/263; 292/DIG. 46

[58] Field of Search ..... 292/262, 263, 338, 339, 292/277, 150, DIG. 46

[56] References Cited

U.S. PATENT DOCUMENTS

| | | | |
|---|---|---|---|
| 1,510,562 | 10/1924 | Segal | 292/150 |
| 2,631,880 | 3/1953 | Vigmostad | 292/263 X |
| 3,698,754 | 10/1972 | Means | 292/DIG. 46 |
| 3,825,290 | 7/1974 | Messina et al. | 292/263 X |
| 4,278,280 | 7/1981 | Rashbaum | 292/338 X |
| 4,391,463 | 7/1983 | Costa Bastart | 292/263 |
| 4,429,912 | 2/1984 | Smith, Jr. | 292/263 |

*Primary Examiner*—Richard E. Moore

*Attorney, Agent, or Firm*—Head, Johnson & Stevenson

[57] ABSTRACT

A locking device for sliding doors and/or windows and comprising a pair of bar or tube assemblies hingedly secured in end-to-end relation and having an internal spring urged slide apparatus engagable with the two tube assemblies for locking thereon in the extended position therebetween, the slide apparatus being movable for disengagement with one of the tube assemblies whereby the tube assemblies are free to pivot about the hinged connection to permit opening of the door and/or window, the slide apparatus also being movable to a first position for locking the tube assemblies in the extended position, and to a second position for precluding accidental locking of the tube assemblies.

3 Claims, 11 Drawing Figures

LOCKING DEVICE FOR SLIDING DOORS AND/OR WINDOWS

BACKGROUND OF THE INVENTION

1. Field of the Invention

This invention relates to improvements in locking devices and more particularly, but not by way of limitation, to a hinged bar means for securing sliding doors and/or windows in a closed or locked position.

2. Description of the Prior Art

Sliding doors and windows are in widespread use today in building construction, and particularly in residential construction. The relative ease with which these doors and/or windows can be "pried" or otherwise opened by unauthorized personnel has created a problem in maintaining the residence or other building secure against unauthorized entry. Many devices have been developed as a deterent or for locking these sliding door and/or windows in the closed position, such as shown in the Hodge U.S. Pat. No. 3,478,471, issued Nov. 18, 1969, and entitled "Auxiliary Lock for Sliding Members;" Mueller U.S. Pat. No. 3,608,940, issued Sept. 28, 1971, and entitled "Slidable Door Safety Lock;" Harris U.S. Pat. No. 3,615,114, issued Oct. 26, 1971, and entitled "Burgular Proof Lock for Sliding Glass Doors;" Means U.S. Pat. No. 3,698,754, issued Oct. 17, 1972, and entitled "Lock for Sliding Door or Window;" Shiffler et al U.S. Pat. No. 3,820,285, issued June 28, 1974, and entitled "Blocking Device for Locking Sliding Closures;" Messina et al U.S. Pat. No. 3,825,290, issued July 23, 1974, and entitled "Sliding Door Lock Bar Apparatus;" Tierney U.S. Pat. No. 4,073,522, issued Feb. 14, 1978, and entitled "Security Step or Stop for Slidable Door;" and the Clark U.S. Pat. No. 4,314,721, issued Feb 9, 1982, and entitled "Security Bar for Sliding Door or Window." These devices have certain disadvantages, however, in that they are frequently of an expensive construction, and many are difficult to install, particularly in the case of an elderly or infirm individual living alone and wherein the cost of hiring installation personnel becomes a problem. The Tierney U.S. Pat. No. 4,073,522, for example, comprises a hinged bar adapted to be disposed in the track along which the door moves and is to be moved between an extended position and a "folded" position to provide alternate locked and unlocked positions for the door. The moving of the hinged bar into the locked position may require considerable downward force against the hinge element, particularly if the bar is to be wedged tightly enough to prevent unauthorized opening of the door. In addition, the "breaking" of the hinge element for folding of the bar to permit an opening of the door may be difficult, and requires stooping of the individual using the device. The Messina et al patent provides a pair of rigid bars hingedly secured together and wherein one end of one of the bars is rigidly secured to a non-movable portion of the frame, and the outer end of the other bar is rigidly secured to the frame of the sliding panel or door. This arrangement generally reaches a solution to the problem, but has disadvantages in that the installation of the device is somewhat difficult and the overall construction of the device is somewhat impractical.

SUMMARY OF THE INVENTION

The present invention contemplates a novel means for locking slidng doors and/or sliding windows which has been particularly designed and constructed for overcoming the foregoing disadvantages. The novel device comprises a pair of elongated tube or bar members arranged in end to end relation and having the abutting ends thereof hingedly secured together. Each bar is preferably of a telescoped construction whereby the length of each may be adjusted. The outer end of each bar is provided with a pivotal foot plate means for facilitating securing of the device between a pair of panels wherein at least one of the panels is a sliding panel. An extendable and retractable slide means is disposed in one of the bar or tube members and is retained in a normally extended position by suitable spring means whereby it is engagable with the other bar or tube means when the tube members are disposed in substantial axial alignment. Manually operable means extends from the slide means for actuation from the exterior of the bar means in order that the slide means may be moved against the force of the spring means for releasing the engagement between the slide and the other bar. When the slide is thus removed from engagement with the other bar, the bars or tubes may be pivoted about the hinge connection therebetween to provide a folded or collapsed position for the locking device. When the doors and/or windows are in an open position, the two bar members collapse to a substantially mutually parallel and abutting relationship which substantially preclude any hindrance with the open position of the doors and/or windows. The device may be readily installed at the site of the door or window with which it is to be utilized, and in order to expedite an initial installation of the device, the outer face of each end plate may be provided with an adhesive surface whereby the first end plate may be adhesively affixed against one door or window frame and the second end plate may be similarly affixed against the other door or window frame. The overall length of the bar or bars may be adjusted in accordance with the size or dimensions of the space wherein the device is to be installed, it being important that the hinge means is disposed centrally between the two end plates in the installed position of the device. As long as the bars are arranged in the extended or end-to-end relation, the door and/or window cannot be opened from either the inside of the building or the outside thereof. When the slide means is manipulated for releasing the engagement thereof between the two bars, the device will automatically fold at the hinge area as the door and/or window is moved in the direction toward the mating door or window for precluding interference with the normal opening of the door or window. Conversely, the bars will automatically pivot about the hinge means into an end-to-end relationship when the door and/or window is moved into the normal closed position thereof. Of course, in the event one intends to close the door without locking thereof, the slide means may be locked in the disengaged position, thereby precluding an accidental locking of the door when access therethrough is required by authorized personnel. The novel sliding door and/or window locking device is simple and efficient in operation and economical and durable in construction.

DETAILED DESCRIPTION OF THE PREFERRED EMBODIMENT

Figure 1:
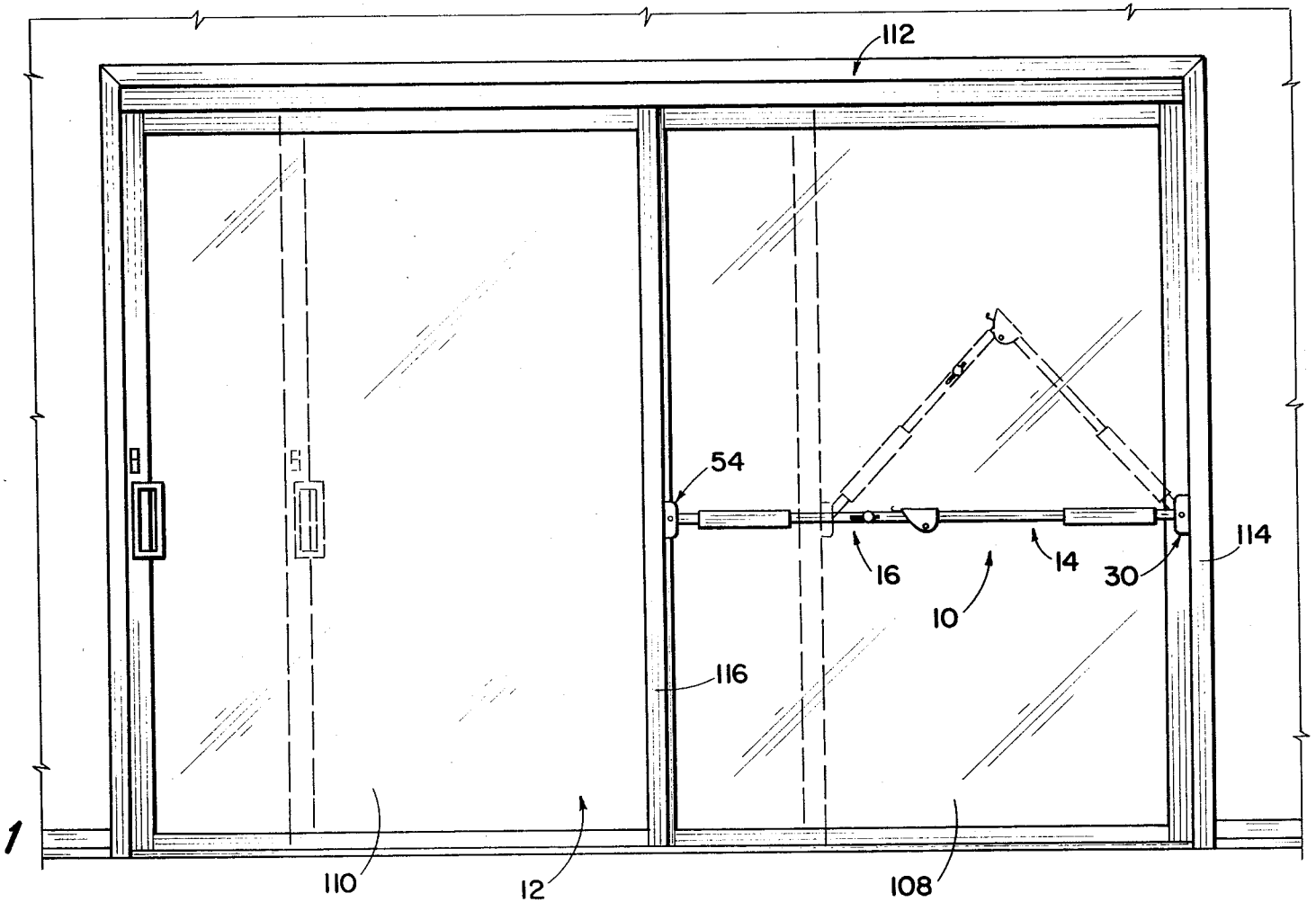
FIG. 1 is a front elevational view of a sliding door assembly having a locking device embodying the invention installed thereon, with a locked position of the device shown in solid lines and an unlocked position thereof shown in broken lines.
Figure 2:
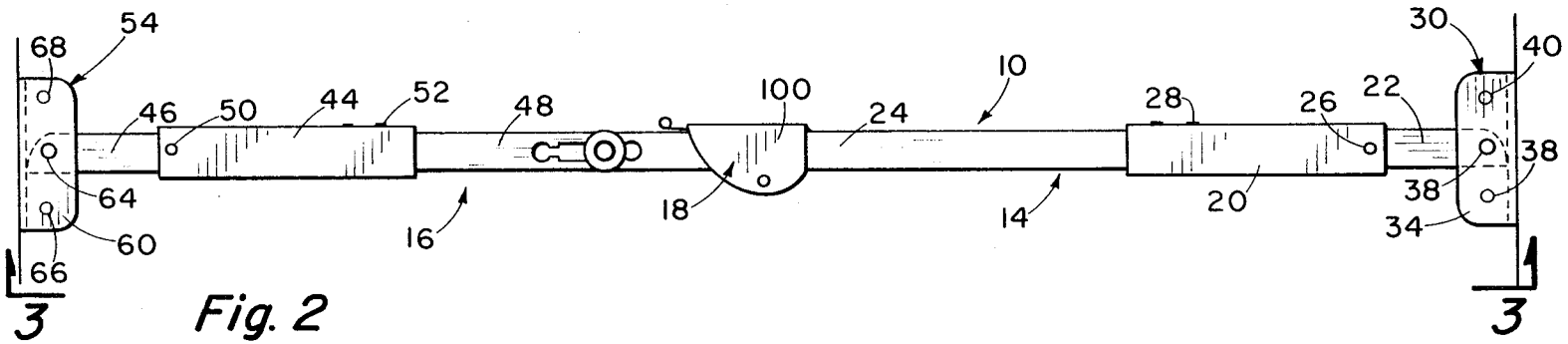
FIG. 2 is a side elevational view of a sliding door and/or window locking device embodying the invention and shown in an extended or locked position.

Referring to the drawings in detail, reference character 10 generally indicates a novel locking device for installation in a sliding door or sliding window assembly. As particularly shown herein, the device 10 is installed in a sliding door assembly 12, but there is no intention of limiting the device to use in a door structure. The locking device 10 comprises a first bar or tube means 14 having one end thereof hingedly secured to a second bar or tube means 16 in any suitable manner, such as by a hinge means 18. The bar or tube means 14 may be of any suitable construction whereby the overall length thereof may be adjusted, and as shown herein comprises a sleeve member 20 having the opposite ends thereof open for slidably receiving tube members 22 and 24 therein. The tube members 22 and 24 may be longitudinally arranged with respect to the sleeve 20 in order to provide the required or desired overall length for the bar 14, as will be hereinafter set forth, and may be secured in the selected positions by suitable set screws 26 and 28, respectively, or the like.

An end cap means 30 comprising an end plate 32 having opposite mutually parallel flange members 34 and 36 extending substantially perpendicularly outwardly therefrom is pivotally secured to the outer end of the tube member 22 as shown at 38. The flanges 34 and 36 are each preferably provided with a pair of spaced apertures 38 and 40, the apertures of one flange being in substantial axial alignment with the apertures of the other flange for facilitating one mode of installation for the device 10. In addition, the end plate 12 is preferably provided with a pair of spaced apertures (not shown) for receiving screws 42, or the like (one of which is shown in FIG. 3) for securing the plate 32 in the door assembly 12 in another mode of installation for the device 10, as will be hereinafter set forth.

The bar or tube means 16 is generally similar to the bar 14 and as shown herein comprises a sleeve member 44 having the opposite ends thereof open for slidably receiving tube members 46 and 48 therein. The overall length of the bar 16 may be adjusted as required or as desired by adjusting the relative longitudinal position of the tubes 46 and 48 with respect to the sleeve 44, and the tubes 46 and 48 may be secured in the selected positions therefor in any suitable manner, such as by set screws 50 and 52, or the like. The adjustment of the length of both the bar 14 and 16 is important in the position of the hinge means 18 and is preferably centrally disposed in the overall length of the apparatus 10 in order to assure an efficient operation of the device.

Figure 3:
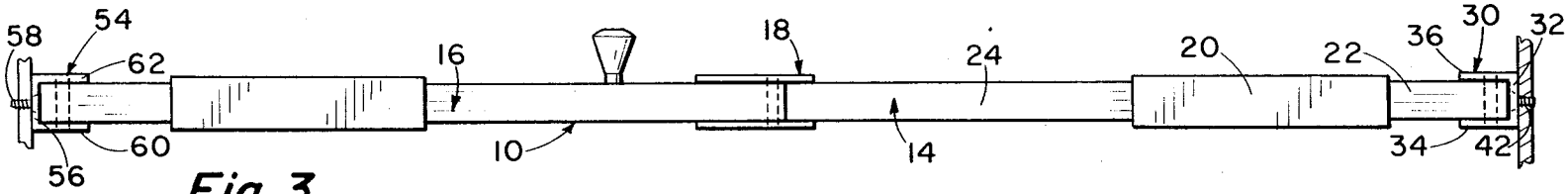
FIG. 3 is a view taken on line 3—3 of FIG. 2.

An end cap means 54, generally similar to the end cap means 30, is provided at the outer end of the tube member 46, and preferably comprises an end plate 56 provided with a pair of spaced apertures (not shown) for receiving screws 58 therethrough (only one of which is shown in FIG. 3) for facilitating one mode of installation of the device in the door assembly 12. A pair of oppositely disposed flanges 60 and 62 extend substantially perpendicularly outward from the plate 56 and are pivotally secured to the outer end of the tube 46 as shown at 64. In addition, it is preferable to provide a pair of spaced apertures 66 and 68 in each of the flanges 60 and 62, the apertures of the two flanges being in substantial axial alignment for facilitating another mode of installation for the device 10, as will be hereinafter set forth in detail.

Figure 4:
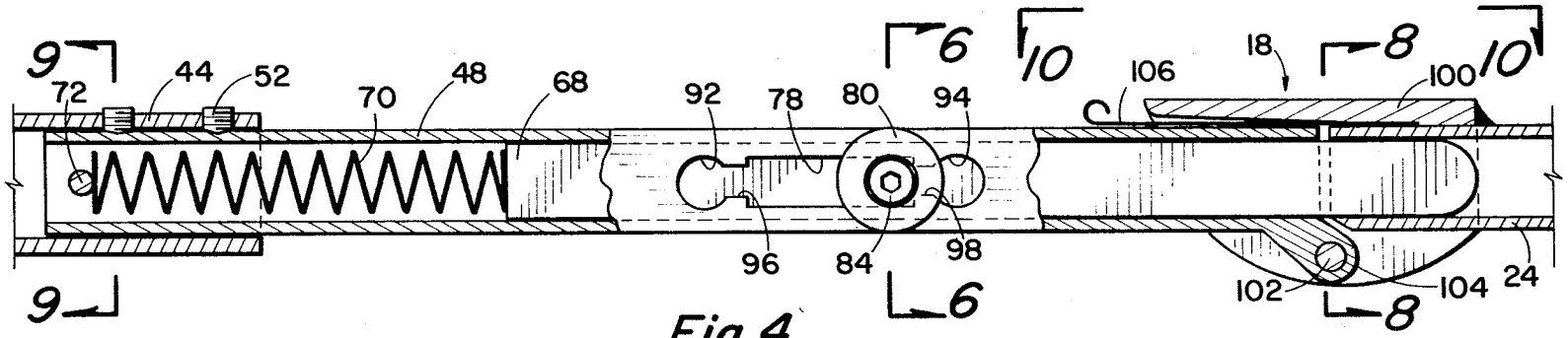
FIG. 4 is an enlarged sectional elevational view, partly in elevation, of a locking element which may be used in a door and/or window locking device embodying the invention, and illustrated in a locked position.
Figure 5:
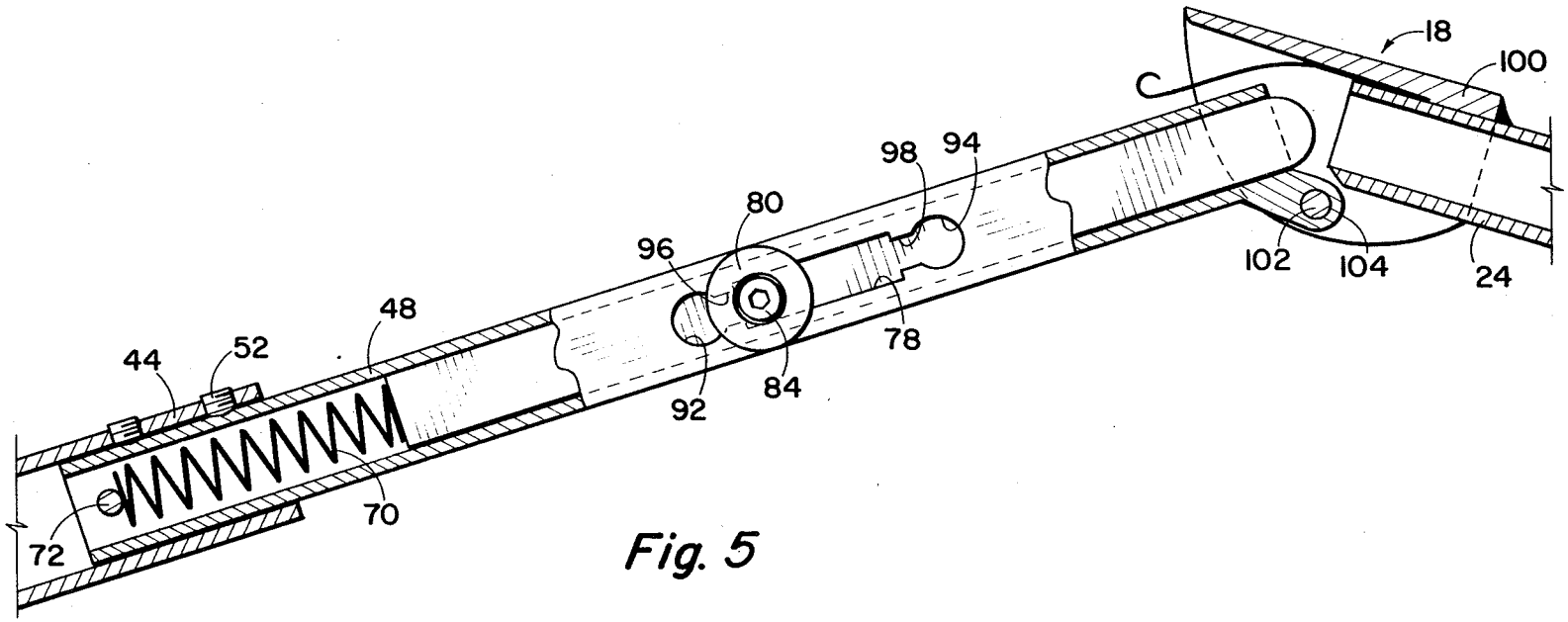
FIG. 5 is a view similar to FIG. 4 showing the locking element in a released or unlocked position.

A slide means 68, preferably constructed from a suitable nylon material, or the like, but not limited thereto, is slidably disposed within the tube means 48, as particularly shown in FIGS. 4 and 5. A suitable helical spring means 70 is anchored between one end of the slide 68 and a cross pin 72 secured across the tube 48, preferably in the proximity of the end thereof which is disposed within the sleeve 44. The outer or opposite end of the slide means 68 is urged in a direction toward the outer end of the tube means 48, and normally extends axially outwardly therefrom in response to the force of the spring means 70 acting against the slide means. A transversely extending threaded bore 74 is provided in the slide means 68 for receiving a shaft member 76 therein. The shaft 76 extends outwardly from the outer periphery of the slide means 68 and through an elongated slot 78 provided in the sidewall of the tube 48.

Figure 6:
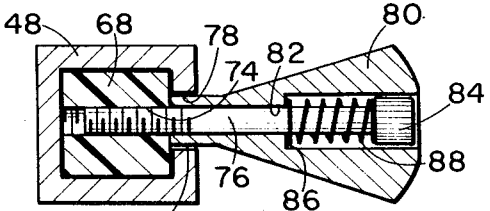
FIG. 6 is a view taken on line 6—6 of FIG. 4.

A knob or handle means 80 is provided with a centrally disposed longitudinally extending bore 82 for receiving the shaft 76 therethrough. A cap member 84 is provided at the outer end of the shaft 76 and may either be integral therewith or secured thereto, as desired. The bore 82 is enlarged at 86 to provide an annular shoulder around the inner periphery thereof, and a suitable helical spring means 88 is disposed within the bore 82 and around the outer periphery of the shaft 76. The spring means 88 is anchored between the head member 84 and the shoulder 86 and constantly urges the knob member 80 in a direction toward the slide means 68, as particularly shown in FIG. 6. The knob 80 is provided with a neck member 90 which passes through the slot 78, and as the knob 80 is manually moved to and fro within the slot 78, the slide means 68 may be moved simultaneously therewith, for a purpose as will be hereinafter set forth.

Figure 7:
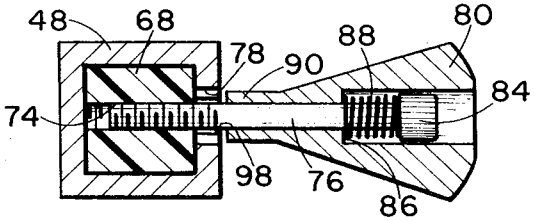
FIG. 7 is a view similar to FIG. 6 and illustrates an alternate position for the locking element.

The slot 78 is preferably provided with enlarged or bulbous openings 92 and 94 at the opposite ends thereof and open to the central portion of the slot 78 through restricted passageways 96 and 98, respectively. When manual pressure or force is applied against the knob means 80 in an axial or longitudinal direction, the force of the spring means 80 may be overcome whereby the knob means 80 may be removed from engagement with the slide means 68, as particularly shown in FIG. 7. In this position, the knob may be moved through either of the restricted passageways 96 or 98, and into the respective enlarged portion 92 or 94, whereupon the slide means 68 may be locked in either a fully contracted position within the tube 48 or a fully extended position with respect to the tube 48, for a purpose as will be hereinafter set forth.

The hinge means 18 may be of any suitable construction, and as shown herein comprises a saddle or channel member 100 welded or otherwise rigidly secured to one end of the tube 24 and preferably extending slightly therebeyond for receiving one end of the tube 48 therein. A hinge or pivot pin 102 is secured between the sides of the channel 100 and disposed in slightly spaced relation with respect to the outer periphery of the tube 24, as will be particularly seen in FIGS. 4 and 5. An apertured boss or sleeve member 104 may be either integral with or welded to the end of the tube 48 disposed adjacent the end of the tube 24 and is journalled on the pivot pin 102 for free rotation about the longitudinal axis thereof. A flat spring means 106 may have one end secured between the outer periphery of the tube 24 and the inner periphery of the channel member 100, and the opposite end thereof projecting beyond the outer limit of the tube 24, if desired. When the tubes 24 and 48 are disposed in an end-to-end relation, with the slide means 68 extending into the interior of the tube 24, as shown in FIG. 4, the spring means 106 overlays the outer periphery of both tubes 24 and 48. When the slide means 68 is retracted to a position substantially encased within the interior of the tube 48 as shown in FIG. 5, the spring means 106 quickly urges the tubes 24 and 48 a relatively angular orientation as shown in FIG. 5, thus facilitating the collapsing or folding of the device 10 for a purpose as will be hereinafter set forth.

Assuming that the device 10 is to be installed in the sliding door assembly 12, and further assuming that the door assembly 12 comprises a first stationary door 108 and a relatively slidable door 110 mounted in the usual doorway framing assembly 112, the apparatus or device 10 may be installed between one upright side 114 of the frame assembly and the outer edge of the nearest upright post 116 of the slidable door 110, as particularly shown in FIG. 1. When the device 10 is locked in the extended position thereof, as shown in solid lines in FIG. 1, the slidable door cannot be moved, and when the device 10 is in the unlatched position for folding as shown in broken lines, the door 110 may be freely moved between an open and closed position.

Figure 11:
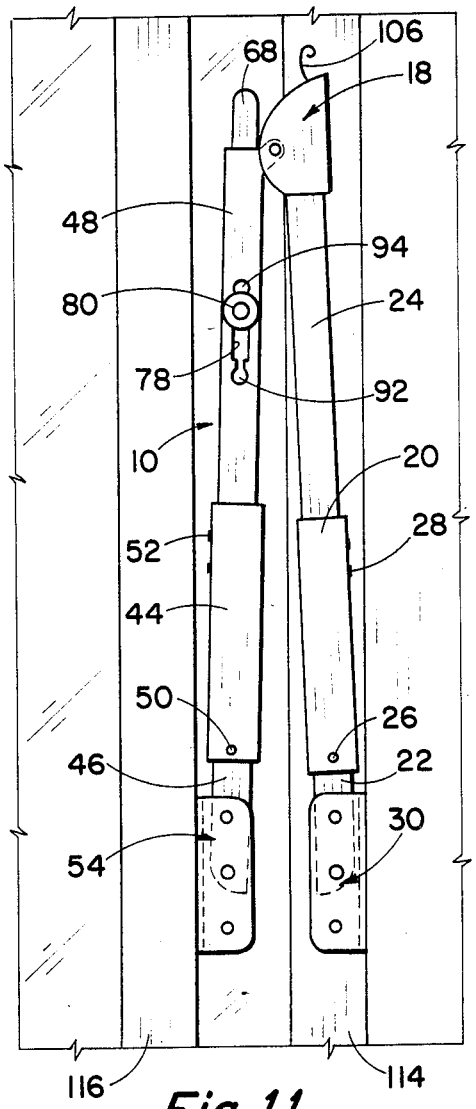
FIG. 11 is a front elevational view of a door and/or window locking device embodying the invention as installed in a sliding door assembly, and illustrated in the unlocked position of the locking device and open position of the sliding door assembly.
Figure 8:
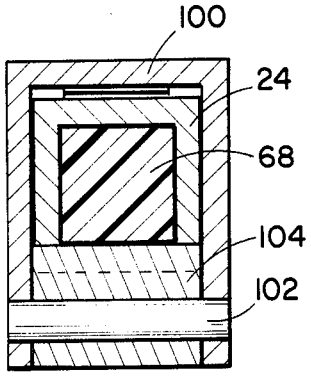
FIG. 8 is a view taken on line 8—8 of FIG. 4.
Figure 9:
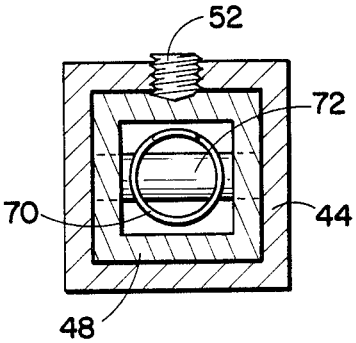
FIG. 9 is a view taken on line 9—9 of FIG. 4.
Figure 10:
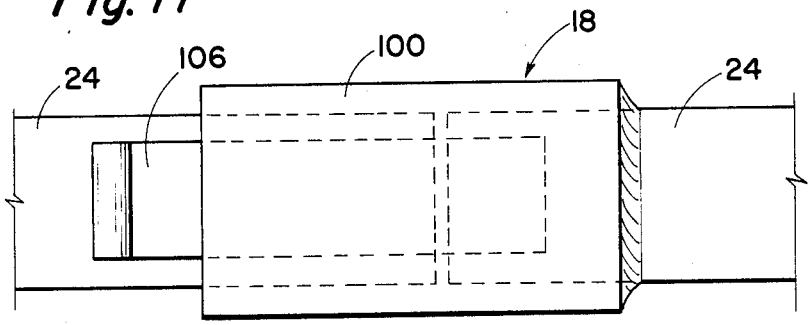
FIG. 10 is a view taken one line 10—10 of FIG. 4.

As long as the knob means 80 is disposed within the slot 78 and interposed between the restrictions 96 and 98, the spring means 70 constantly urges the slide means 68 in a direction toward the tube 24. When the tubes 24 and 48 are disposed in the extended end-to-end relationship therebetween, the slide means 68 extends into the interior of the tube 24 as well as within the interior of the tube 48, thus securely retaining the tubes 24 and 48 in the extended position and precluding movement of the sliding or movable door 110 in a direction toward the stationary door 108. In the event it becomes desirable to open the door 110, or move the door 110 in a direction toward the door 108, the knob means 89 may be manually grasped and moved within the slot 78 in a direction away from the tube 24, whereupon the slide means 68 is moved to a contracted position within the tube 48. The spring member 106 then automatically causes the hinged connection between the tubes 24 and 48 to "break" and permit the tubes 24 and 48 to move toward the collapsed position thereof as shown in broken lines in FIG. 1. When the door 110 is in the full open position thereof, the tubes 24 and 48 will be disposed in a substantially abutting mutually parallel position as shown in FIG. 11.

In the event it is desirable to positively lock the device 10 in the extended or locking position thereof, the knob means 80 may be manually pulled outwardly for disengagement thereof from the slide means 68 and moved through the restriction 98 and into the bulbous portion 94. As long as the knob means 80 is disposed within this position, the slide means 68 is locked in the engaged position with the interior of the tube 24, and the hinge means 18 cannot function to permit a folding of the device. Similarly, when it is desired to secure the device 10 in the unlocked position thereof, the knob means 80 may be moved through the restriction 96 and disposed within the bulbous portion 92 whereupon the slide means 68 will be securely retained in the contracted position thereof within the tube 48. In this manner, no accidental locking of the door 108 against opening thereof can occur. This may be important in the event one leaves the interior of the residence, building, or the like, wherein the door assembly 12 is installed and does not want the door to be accidentally locked whereby one cannot return to the interior thereof.

In order to secure the device between the frame members 114 and 116, it may be desirable to provide each of the end plates 32 and 56 with suitable adhesive means (not shown) on the outer surface thereof. The adhesive means may be of the well known strip-type having a protective cover sheet removably adhered to the adhesive face thereof, and upon removal of the protective cover, the end plate 32 may be adhesively secured against the frame member 114 and the end plate 56 may be adhesively secured against the frame member 116. This simple and quick installation method permits ready installation of the device by substantially anyone, including an elderly or infirm person. Of course, a more permanent installation may be achieved at a later time by securing the end plates 32 and 56 in position by means of the screws 42 and 58, respectively. As hereinbefore set forth the overall length of the device 10 may be adjusted in accordance with the dimensions of the door assembly 12 wherein the device is installed. It is important that the hinge means 18 be centrally disposed between the end members 30 and 54.

Whereas the particular installation shown in FIG. 1 illustrates the end plates 32 and 56 as being secured against the posts or frame members 114 and 116, respectively, it is to be noted that in some instances it may be desirable to secure the side flanges 34–36 and 60–62 of the end members 30 and 54 in a side-type engagement with the frame of the door assembly 12. In this event the apertures 38 and 40 of the end member 30 and the apertures 66 and 68 of the end member 54 may be utilized for receiving suitable screws (not shown) or the like therethrough for securing the device in position within the door assembly 12.

From the foregoing, it will be apparent that the present invention provides a novel locking device for sliding doors and/or windows and which provides a hinged elongated bar assembly adapted to be secured between the stationary door or window and the movable door or window in a manner for automatically locking the door or window assembly against unauthorized entry. The novel device includes a pair of tube assemblies secured in end-to-end relation by a hinge means and a spring urged slide means internally arranged within the tube assemblies in such a manner as to retain the assemblies in the extended position thereof, and movable for releasing the assemblies for a folding at the hinge connection therebetween. In the extended position of the assemblies, the door or window is securely locked against entry, and in the folded position therebetween, the movable door is free for movement between an open and closed position. The slide means may also be positioned for positively locking the tube assemblies in the extended end-to-end relation therebetween and also positioned for releasing the locking engagement between the tube assemblies.

Whereas the present invention has been described in particular relation to the drawings attached hereto, it should be understood that other and further modifications, apart from those shown or suggested herein may be made within the spirit and scope of this invention.

What is claimed is:

1. A locking device for a sliding door and/or window assembly and comprising:

a first and a second elongated tubular bar assembly, the bar assemblies being hingedly secured together in end-to-end relation, each bar assembly being formed of a tubular walled member and each having an inner end and an outer end, the bar assemblies being hinged to each other at the inner ends, the first bar assemblies having an elongated slot in the tubular wall, the longitudinal axis of the slot being parallel the bar member longitudinal axis, the slot being of selected width and having an intermediate portion and reduced width stop portions adjacent to and spaced from each end providing first and second slot locking portions;

pivotal end plate means secured to the outer end of each bar assembly for engagement with the doors and/or windows of the sliding doors and/or window assembly;

a slide member slideably received in said first tubular bar assembly and being moveable between a first position of internal engagement with both bar assemblies and a second position out of engagement with said second bar assembly to provide locking of the bar assemblies in an extended end-to-end relationship in the first position and unlocking of the bar assemblies for pivotal movement about the hinged connection therebetween in the second position;

spring bias means normally urging said bar assemblies out of end-to-end relationship;

a small diameter shaft secured to and extending radially from said slide member through said slot;

a knob member slideably received on said shaft, the knob member being dimensioned on its inner end to be slideably received in said slot and being postionable in said slot locking portions by outward pull thereon;

spring bias means normally urging said knob member inwardly towards said slide member, said slot being dimensioned so that said slide member can be moved between a locking and an unlocking position by said knob member in said slot intermediate portion and said slide member can be secured in a locked or an unlocked position by first outward pull on said knob member.

2. A locking device according to claim 1 wherein each said bar assemblies includes means whereby the overall length thereof may be adjusted.

3. A locking device according to claim 1 including:

spring bias means within said first bar assembly urging said slide member towards the locking position.

* * * * *